United States Patent [19]

Dalo et al.

[11] Patent Number: 4,890,634

[45] Date of Patent: Jan. 2, 1990

[54] FRAMEWORK FORMING SUPPORT FOR A TENT CANVAS OF A LIGHT SHELTER

[76] Inventors: Jean Dalo, 1, rue Beaurepaire, 91410 Roinville-sur-Dourdan; Pierre Dalo, ZAC du Bel-Air - Rue Pierre Métairie, 78120 Rambouillet, both of France

[21] Appl. No.: 189,428

[22] Filed: May 2, 1988

[30] Foreign Application Priority Data

May 7, 1987 [FR] France ..... 87 06477

[51] Int. Cl.[4] ..... E04H 15/26

[52] U.S. Cl. ..... 135/99; 135/101; 135/DIG. 8; 135/DIG. 9

[58] Field of Search ..... 135/99, 100, 101, 106, 135/DIG. 9, DIG. 8, 105; 52/82, 222

[56] References Cited

U.S. PATENT DOCUMENTS

| | | | |
|---|---|---|---|
| 519,178 | 5/1894 | Douglas et al. | 135/99 |
| 690,102 | 12/1901 | Dummer, Jr. | 135/99 |
| 988,401 | 4/1911 | Stonebridge | 135/99 |
| 1,400,066 | 12/1921 | Huck | 135/DIG. 9 |
| 1,642,267 | 9/1927 | Rush | 135/106 |
| 3,461,626 | 8/1969 | Aitken | 52/82 |
| 3,810,481 | 5/1974 | Nohmura . | |
| 3,952,463 | 4/1976 | Lane | 52/82 |
| 4,637,748 | 1/1987 | Beavers | 52/82 |

FOREIGN PATENT DOCUMENTS

| | | | |
|---|---|---|---|
| 449233 | 4/1968 | Switzerland | 135/99 |
| 9874 | of 1887 | United Kingdom | 135/100 |

*Primary Examiner*—David A. Scherbel
*Assistant Examiner*—Caroline D. Dennison
*Attorney, Agent, or Firm*—McAulay Fisher Nissen & Goldberg

[57] ABSTRACT

A framework forming support for a tent canvas of a light shelter which is stretched in substantially pyramidal form, abutting, at its center, on the top of a vertical central pole, comprises a rigid frame in the form of a regular polygon, defining the base of the pyramid and to the sides of which the canvas is hooked. The lower end of the central pole being is located at a level higher than the horizontal plane of the polygonal frame. The pole is maintained vertically by inclined rigid arms whose upper ends are rigidly coupled, in common, to the lower end of the pole. The lower ends of the arms are coupled to the sides of the polygonal frame, the points of connection of two adjacent inclined arms with two adjacent sides of the frame being symmetrical with respect to the bisectrix of the angle formed by these two sides. Crosspieces extend respectively across the angles of the frame, between points of hooking on the sides of the frame which are symmetrical with respect to the bisectrix of each angle.

20 Claims, 3 Drawing Sheets

FRAMEWORK FORMING SUPPORT FOR A TENT CANVAS OF A LIGHT SHELTER

BACKGROUND OF THE INVENTION

The present invention relates to a framework forming support for a tent canvas of a light shelter which is stretched in a substantially pyramidal form.

The majority of stretched textile structures which constitute "tent canvas" are generally bordered along their lower perimeter, by which they are connected to elements for hooking the canvas, by means of cables or ropes which take up the efforts due to the tension of the canvas and which result either from the tension of shaping said canvas or from the effects of snow and wind on the canvas. The tensile loads are transferred on the one hand on a central pole abutting on the ground and on the other hand on an assembly of materials in compression and of bracing wires in traction.

Such a structure presents several drawbacks. In the first place, the presence of the central pole in abutment on the ground is very often a cause of hindrance to movement inside the shelter and it limits the possibilities of use. Furthermore, under the effect of the tension of the canvas the ropes take a curved form between two points of hooking, which makes it very difficult hermetically to connect two or more structures together.

SUMMARY OF THE INVENTION

It is an object of the present invention to overcome these drawbacks by providing a framework of particularly simple design, eliminating descent of the central pole as far as the ground whilst allowing hermetic connections of the frameworks without difficulty.

To that end, said framework forming support for a tent canvas of a light shelter which is stretched in substantially pyramidal form, abutting, at its centre, on the top of a vertical central pole, is characterized in that is comprises a rigid frame in the form of a regular polygon, defining the base of the pyramid and the canvas being hooked to the sides of the base. The lower end of the central pole is located at a level higher than the horizontal plane of the polygonal frame, the pole being maintained vertically by inclined rigid arms whose upper ends are rigidly coupled, in common, to the lower end of the pole and whose lower ends are coupled to the sides of the polygonal frame, the points of connection of two adjacent inclined arms with two adjacent sides of the frame being symmetrical with respect to the bisectrix of the angle formed by these two sides and crosspieces extending respectively across the angles of the frame, between points of hooking on the sides of the frame which are symmetrical with respect to the bisectrix of each angle.

As the framework according to the invention comprises at its base a frame in the form of a regular polygon (triangular, square, hexagonal, etc..), it is possible to juxtapose several frameworks, so as to increase the total surface covered, the polygonal frames of two adjacent frameworks then being joined by two of their adjacent sides maintained tightly against one another by any appropriate means.

The polygonal frame of the framework may rest on the ground via posts, low walls, etc.. or it may simply cover a work In any case, there is no transfer of internal efforts on the supporting structure and the only efforts to which this structure supporting the framework is subjected are limited to the weight of this framework and to the load due to the effects of snow or wind.

BRIEF DESCRIPTION OF THE DRAWINGS

The invention will be more readily understood on reading the following description with reference to the accompagnying drawings, in which.

DESCRIPTION OF THE PREFERRED EMBODIMENTS

Figure 1:
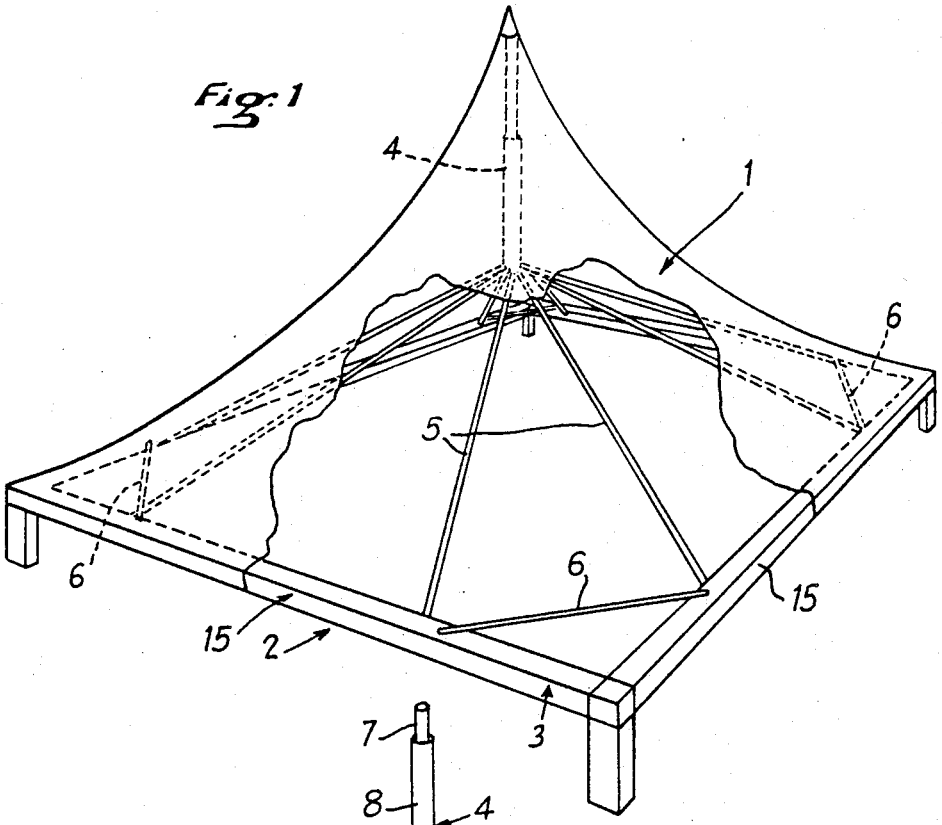
FIG. 1 is a view in perspective of a light shelter comprising a tent canvas stretched over framework according to the invention.

Referring now to the drawings, the light shelter shown in FIG. 1 comprises a tent canvas 1 of pyramidal form which is stretched on a framework 2 according to the invention. This framework 2 essentially comprises a horizontal lower frame 3 in the form of a regular polygon, a square in the particular case illustrated, a vertical central pole 4, on the upper end of which abuts the top of the pyramidal tent canvas 1, inclined rigid arms 5 ensuring connection between the lower end of the central pole 4 and the sides of the frame 3, and crosspieces 6 extending across two sides of the frame connected together and forming an included angle between the two sides of the frame 3.

Figure 2:
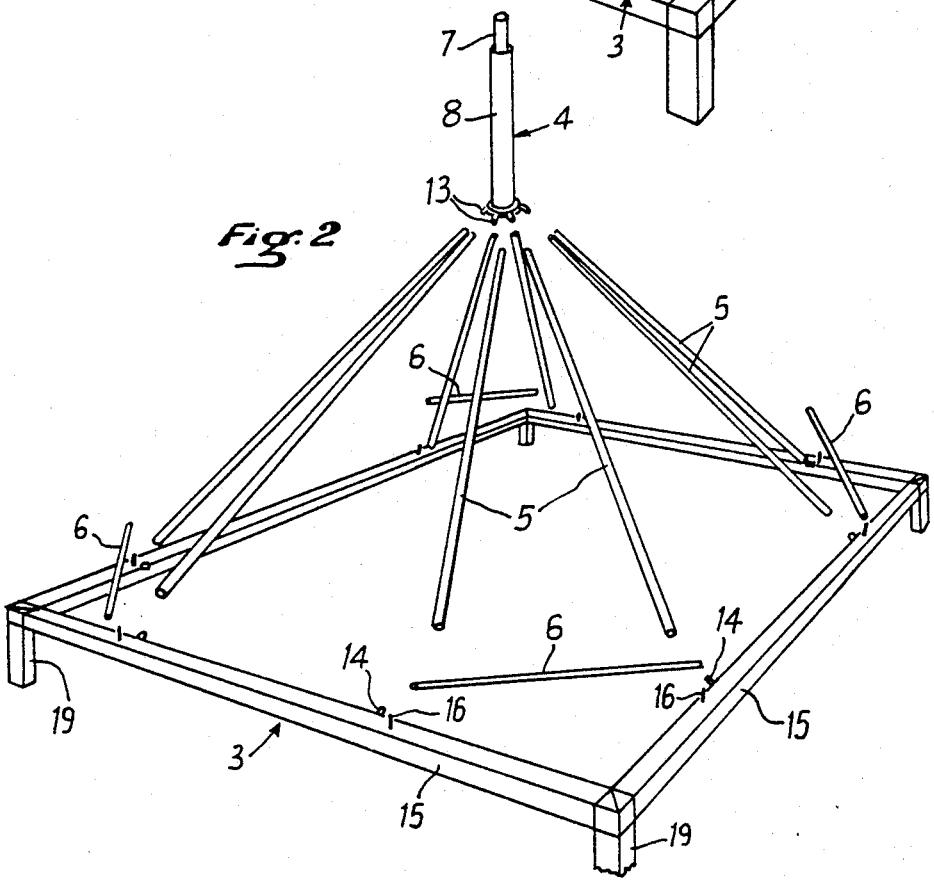
FIG. 2 is an exploded view in perspective of the framework according to the invention.
Figure 3:
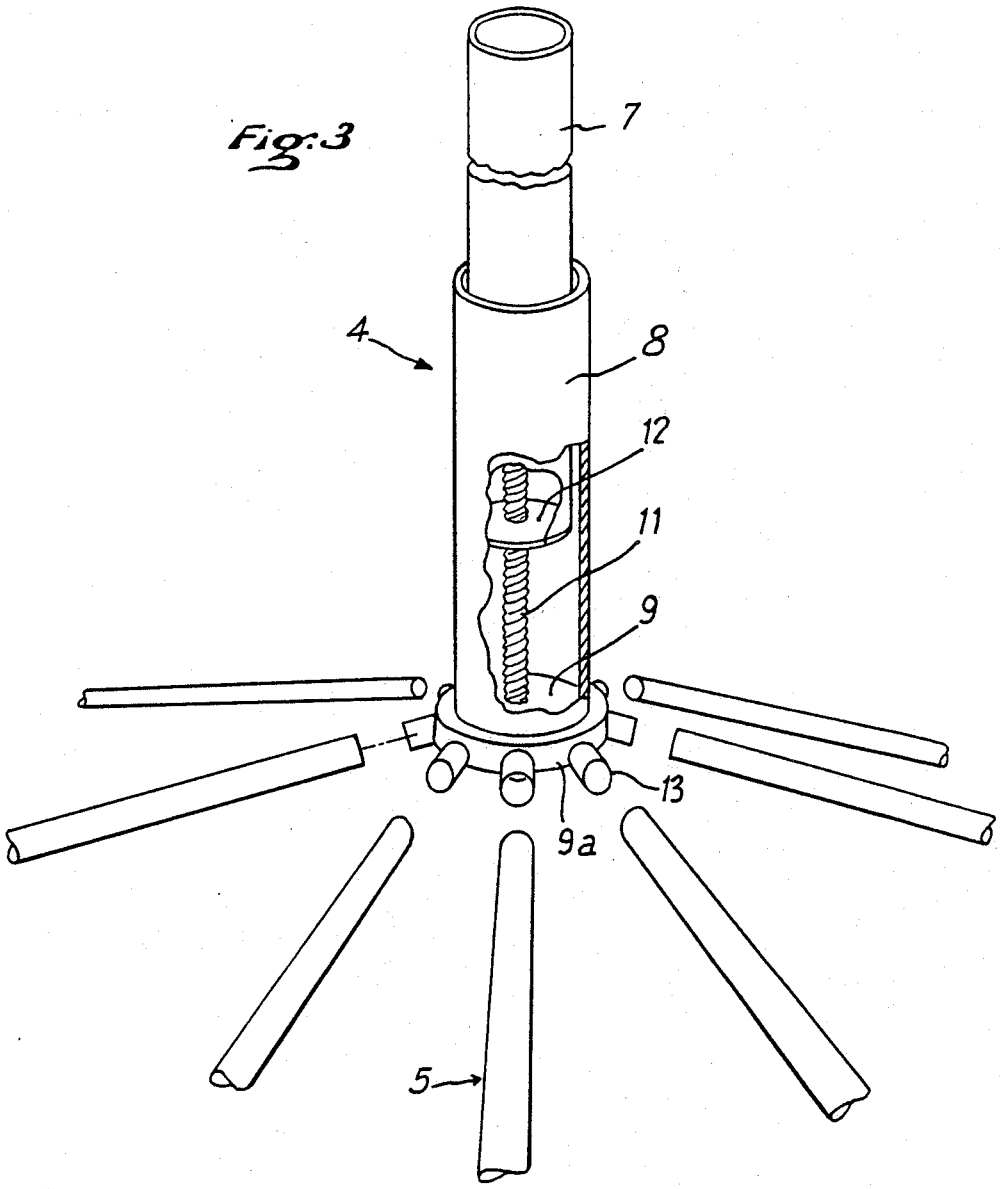
FIG. 3 is a view in perspective, on a larger scale, illustrating a mode of connection of the inclined rigid arms with the lower end of the vertical central pole.
Figure 4:
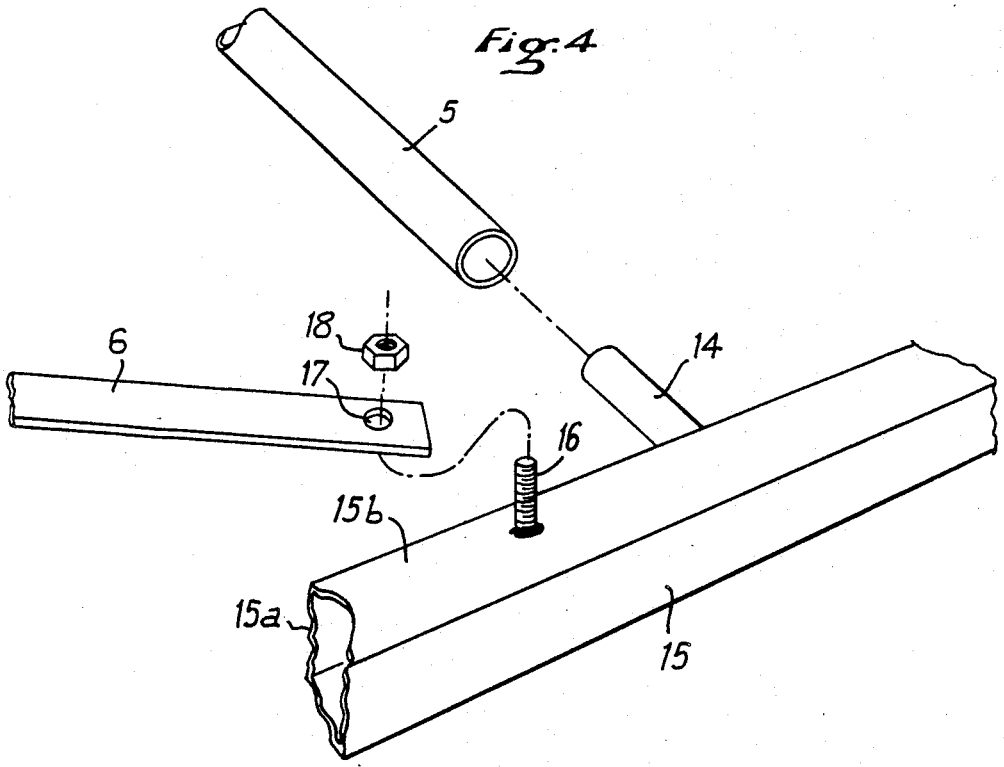
FIG. 4 is a view in perspective of a device for connection one side of the frame with an inclined arm and a crosspiece.
Figure 5:
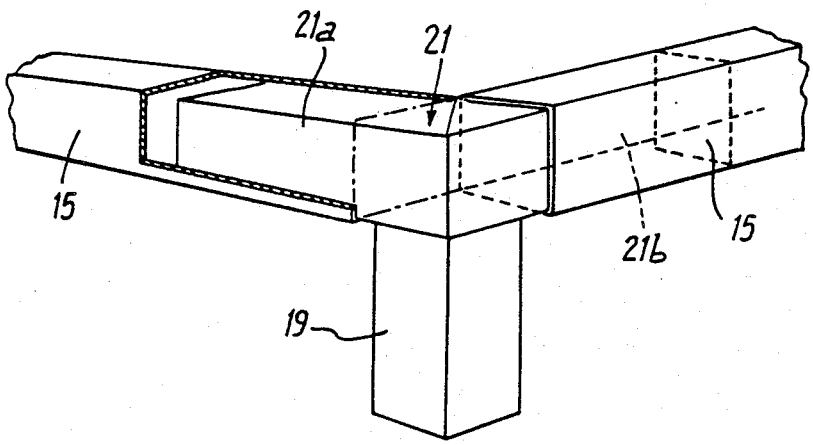
FIG. 5 is a view in perspective, with parts torn away, of a device for connecting two adjacent sides of the same frame.

As may be more readily seen in FIGS. 2 and 3, the central vertical pole 4 is constituted by two tubes 7 and 8 fitting one in the other and forming a telescopic assembly, namely an upper tube 7 of small diameter engaged in a lower tube 8 of larger diameter, and the central vertical pole 4 is provided with a device for varying the total height of the telescopic pole constituted by the two tubes 7,8 and consequently the tension of the canvas 1. The lower tube 8 of the pole 4 is closed, at its lower end, by a circular transverse cheek element 9 which is traversed by a screw 11 forming part of a device for adjusting the tension of the canvas. This screw 11 is screwed in the lower bottom 12 which is the bottom of upper tube 7 and forms a nut for the upper screw 11, the bottom 7 being integral with the upper tube 7. The circular cheek 9 which forms the bottom of the lower tube 8 has a diameter greater than that of this tube 8 and it bears, on its cylindrical lateral surface 9a, nipples 13 distributed around the vertical axis of the pole and in a number equal to that of the arms 5. The axis of each of the nipples 13 is inclined downwardly so as to merge with that of the rigid connecting arms 5 once the latter are mounted. Each of the arms 5 is constituted by a section of tube of which the inner diameter corresponds to the outer diameter of a nipple 13, so as to be able to be fitted thereon. Each arm 5 is, furthermore, fitted by its lower end part, on a cylindrical nipple 14, of outer diameter equal to the inner diameter of the tubular arm 5 and which is fixed on a side 15 of the frame, each nipple 14 being inclined, with respect to side 15, so that its axis merges with that of the rigid connecting arm 5 once the latter is mounted. Each side 15 of the frame 3 is advantageously constituted by a hollow section, for example of square cross-section, and in that case, each nipple 14 (see FIGS. 2 and 4) is fixed, for example by welding, to the inner vertical face 15*a* of the section 15.

As may be more readily seen in FIGS. 1 and 2, the nipples 14 fixed to two adjacent, i.e. perpendicular sides 15 of the frame 3, are symmetrical with respect to the bisectrix of the angle formed by these two sides, in other words, the two rigid connecting arms 5, connected to these two nipples 14, are themselves symmetrical to each other with respect to a vertical plane containing the bisectrix of the angle formed by the two adjacent sides 15. Consequently the framework comprises a number of inclined arms 5 double that of the sides 15 of the frame 3, in other words, in the particular case of the frame 3 being square, it comprises four pairs of arms 5 associated respectively with the four angles of the frame 3.

Furthermore, each horizontal crosspiece 6 extends across an angle of the frame 3 between two points of hooking symmetrical with respect to the bisectrix of the angle. These points of hooking are located in the immediate vicinity of the nipples 14, as may be more readily seen in FIG. 4. Each point of hooking may be constituted, for example, by a vertical screw 16 fixed, for example by welding, on the horizontal upper frame 15b of the section 15 constituting the side of the frame 3, this screw being intended to extend through a hole provided in the end part of the crosspiece 6. A nut 18 which is screwed on screw 16, in that case ensures blocking of the crosspiece 6 on the upper face 15b of side 15.

It is seen from the foregoing description that the take up of the load of the central pole 4 is ensured, above the level of framework 2, by the rigid connecting arms 5 which abut directly on the frame 3. Furthermore, the cross pieces 6 which extend between the adjacent sides 15, have for effect to cancel the thrusts exerted by the arms 5 on the sides 15 of the frame 3. The positions of the nipples 14 on the sides 15 of the frame 3, i.e. the points of application of the efforts exerted by the arms, are determined so as to obtain equal maximum bending moments on the frame 3, due to the tension of the canvas 1, from one arm 5 to the other and from one arm 5 to the angle of the frame. This arrangement makes it possible to reduce the size of the sections 15 constituting the frame 3, and to obtain deflections compatible with the production of a good tightness.

The frame 3 may rest simply by itself on an appropriate supporting structure or via corner posts 19 as shown in FIGS. 1 and 2. Each post 19 may comprise, at its upper end, a horizontal bracket 21 of which the two arms 21*a* and 21*b* have a square cross-section smaller than the inner cross section of each section 15, so as to be able to be fitted closely in these sections 15.

The framework according to the invention lends itself particularly well to being juxtaposed, in hermetic manner, with another framework of the same type. In fact, it suffices to join the two base frames of the two frameworks and to assemble them, along two adjacent sides 15, by any appropriate means.

Figure 6:
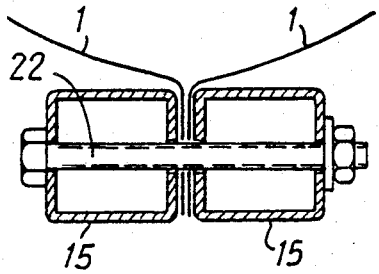
FIGS. 6 and 7 are views in vertical section of two joined frames of two adjacent frameworks maintained assembled by different blocking devices.

As may be more readily seen in FIG. 6, such assembly may be effected by means of horizontal and transverse bolts 22 passing through holes made thereopposite in the two joined sides 15. The lower end parts of the two tent canvases 1 are thus tightly held against each other in hermetic manner.

Figure 7:
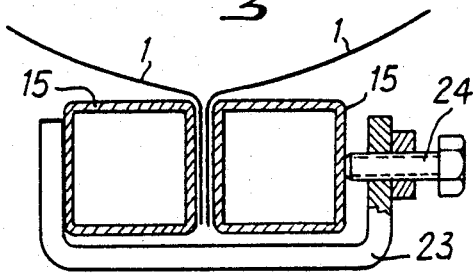

In the variant embodiment of the invention shown in FIG. 7, the two adjacent sides 15 are held tightly against each other by means of a stirrup-shaped clamping member 23 extending beneath the two sides 15, of which the two upwardly directed vertical arms tighten on the two sides 15 and which is blocked by means of a screw 24.

We claim:

1. A framework forming a support for a tent canvas for a light shelter, the tent canvas being stretched in a substantially pyramidal form on the top of a vertical central pole, comprising:

a rigid frame having sides connected together in the form of a regular polygon lying in a horizontal plane and defining a base of a pyramid;

means for hooking the sides of the tent canvas to said rigid frame;

the lower end of said central pole being located at a level higher than the horizontal plane of said polygonal frame;

rigid arms for maintaining said pole vertically, said rigid arms being inclined and having upper ends rigidly coupled in common to the lower end of said vertical central pole;

a bisectrix bisecting the angle formed by two adjacent sides of said frame, the points of connection of two adjacent inclined arms with said two adjacent sides of the frame being symmetrical with respect to said bisectrix of the angle formed by said two sides and displaced from the vertex of said angle;

the said hooking means on the sides of said frame displaced from the vertex of said angle, said hooking means on two adjacent sides of said frame being symmetrical; and crosspieces extending respectively across the angles of said frame between said hooking means defining points of hooking on the sides of said frame which are symmetrical with respect to said bisectrix of each angle.

2. The framework of claim 1, wherein:

said vertical central pole includes two tubes, one of said tubes fitting into the other of said tubes in telescopic manner forming a telescopic pole assembly;

one of said tubes being an upper tube of smaller diameter engaged in the other said said tubes forming a lower tube of larger diameter; and a device coupled with said tubes for varying the total height of the telescopic pole assembly and the tension of the canvas.

3. The framework of claim 2, wherein the lower tube of the pole assembly includes:

a circular transverse cheek element closing the lower end of the lower tube;

said cheek element having on its outer cylindrical lateral surface a plurality of nipples distributed about the vertical axis of said pole assembly, the axis of each of said nipples being downwardly inclined for merging with said rigid connecting arms.

4. The framework of claim 3, wherein:

each of said arms includes a section of tube having an inner diameter corresponding to the outer diameter of said nipple for fitting thereon;

each side of said frame having a frame nipple inclined relative to its respective side; and each said frame nipple having a cylindrical outer diameter equal to the inner diameter of said tubular arm and being fixed to a side of said frame, said nipple being inclined with respect to the side of said frame so that its axis merges with that of said rigid connecting arm after mounting thereof.

5. The framework of claim 3, including:

an adjusting device for said circular transverse cheek element said adjusting device including a screw for adjusting the tension of the canvas; and said screw being screwed into the lower bottom forming a nut of the upper tube.

6. The framework of claim 5, wherein each side of said frame has a hollow section and each said frame nipple is fixed to the vertical face of said section facing the interior of the polygon.

7. The framework of claim 6, wherein the frame nipples fixed to two adjacent sides of said frame are symmetrical with respect to the bisectrix of the angle formed by these two sides.

8. The framework of claim 1, wherein:

each point of connection of said crosspiece includes a vertical screw and a nut therefor;

said vertical screw being fixed on the horizontal upper face of the side of said frame;

said crosspiece being provided with a hole and said screw extending through said hole;

said hole being in the end part of said crosspiece; and said nut for said screw being screwed thereon for ensuring blocking of said crosspiece on the upper face of the side.

9. The framework of claim 1, including:

means for assembling two frameworks together, one of said frames being assembled with the frame of an adjacent framework along two adjacent sides; and means including horizontal transverse bolts for assembling said two frames together passing through holes made thereopposite in the two joined sides.

10. The framework of claim 1, including:

a stirrup-shaped element for assembling two of said frames together along two adjacent sides thereof;

said stirrup-shaped element including a clamping member extending beneath said two sides and two upwardly directed vertical arms on said two sides; and screw means for blocking said two sides between said two upwardly directed vertical arms.

11. A framework arrangement forming support for a tent canvas of a light shelter complex, said framework arrangement comprising at least one framework and a tent canvas thereon stretched in a substantially pyramidal form abutting at a center point of the tent canvas on top of a vertical center pole free of contact with the ground; and said at least one framework comprising:

a rigid closed polygonal frame having a plurality of frame sides to form said closed polygonal frame and each pair of adjacent frame sides forming therebetween an included angle, a first portion of each said pair of adjacent sides extending from the apex of said included angle equal in extent from a bisectrix of each said included angle such that the distance from said bisectrix to both said first portions of each said adjacent sides are equal;

said vertical center pole including first and second pole members telescopically connected with each other;

one of said first and said second pole members including a cheek element, said cheek element including a first, outer connection means fixed with said one pole member and a second, inner connection means movably connected with said other of said first and said second pole members for controlling the telescoping movement between said first and said second pole members;

a rigid arm, cheek connection means and frame side connection means, said rigid arm having one end operatively connected by said frame side connection means to each said first portion of each said pair of adjacent sides remote from said included angle therebetween and having a second end operatively connected to said first, outer connection means of said cheek element by said cheek connection means; and crosspieces each having one end operatively connected with one of said first portions of each said pair of adjacent sides spaced from the end of each said side forming the included angle therebetween and a second end operatively connected with the other of said first portions of each said pair of adjacent sides spaced from the end of each said side forming the included angle therebetween.

12. The framework arrangement of claim 11, including at least two of said frameworks, and connection means for connecting said frameworks together.

13. The framework arrangement of claim 12, wherein said connection means comprises at least one of said plurality of frame sides having an opening therethrough, and transverse nut-bolt arrangement including a transverse bolt and a nut, said transverse bolt passing through said opening in each of two adjacent frame sides, and said nut being tightened onto said bolt for locking said frame sides together for locking said at least two frameworks together.

14. The framework arrangement of claim 12, wherein said connection means comprises a stirrup-shaped clamping member for coupling two adjacent sides of each of said frameworks together, said stirrup-shaped member including a tightening means for tightly coupling said two adjacent sides together.

15. The framework arrangement of claim 14, wherein said stirrup-shaped member has a U-shaped configuration for receiving between the legs of said U-shape said two adjacent sides of the adjacent frameworks, and said tightening means includes a blocking screw coupled with one of the legs of said U-shape and movable relative thereto for engagement with one of said frame sides for holding said adjacent frame sides in a tight relationship relative to each other.

16. The framework arrangement of claim 11, wherein each of said frame sides in said first portion thereof includes first nipple means each spaced equally from said bisectrix forming a first connection means for operatively connecting said crosspieces with said frame sides.

17. The framework arrangement of claim 11, wherein each of said frame sides on said first portion thereof includes second nipple means each spaced equally from said bisectrix forming a first connection means for operatively connecting said rigid arms with said frame sides.

18. The framework arrangement of claim 16, wherein each of said frame sides on said first portion thereof includes second nipple means each spaced equally from said bisectrix forming a first connection means for operatively connecting said rigid arms with said frame sides.

19. The framework arrangement of claim 18, wherein said first and second nipple means on each said frame side are angularly displaced from each other and differently spaced from said bisectrix.

20. The framework arrangement of claim 11, wherein said cheek connection means and said frame side connection means each include aligned nipple means for connection of said rigid arms; and said inner connection means includes a screw receiving element connected with said other pole member and a screw element fixed against rotative relative to said one pole member whereby to permit said aligned nipple means to be maintained in alignment while said telescoping pole members are moved relative to each other.

* * * * *